US005470818A

United States Patent [19]

Nakamura et al.

[11] Patent Number: 5,470,818

[45] Date of Patent: Nov. 28, 1995

[54] PRINTING SHEET COMPRISING A DYE RECEIVING LAYER MADE OF AN ISOCYANATE GROUP-CONTAINING POLYMER

[75] Inventors: Yoshinori Nakamura; Huy Sam, both of Miyagi; Yoshio Fujiwara, Tochigi, all of Japan

[73] Assignee: Sony Corporation, Tokyo, Japan

[21] Appl. No.: 282,499

[22] Filed: Aug. 1, 1994

[30] Foreign Application Priority Data

Aug. 3, 1993 [JP] Japan ..... 5-210978

[51] Int. Cl.[6] ..... B41M 5/035; B41M 5/38

[52] U.S. Cl. ..... 503/227; 427/146; 428/195; 428/423.1; 428/447; 428/913; 428/914

[58] Field of Search ..... 8/471; 428/195, 428/423.1, 447, 913, 914; 503/227; 427/146

[56] References Cited

U.S. PATENT DOCUMENTS

| | | | |
|---|---|---|---|
| 4,684,538 | 8/1987 | Klemarczyk | 427/54.1 |
| 5,182,252 | 1/1993 | Nagasawa et al. | 503/227 |
| 5,187,144 | 2/1993 | Shinohara et al. | 503/227 |

FOREIGN PATENT DOCUMENTS

| | | | |
|---|---|---|---|
| 0349141 | 12/1989 | European Pat. Off. | 503/227 |
| 0505993 | 3/1992 | European Pat. Off. | 503/227 |
| 1-123794 | 5/1989 | Japan | 503/227 |
| 3-126586 | 5/1991 | Japan | 503/227 |
| 3-213397 | 9/1991 | Japan | 503/227 |

*Primary Examiner*—B. Hamilton Hess
*Attorney, Agent, or Firm*—Hill, Steadman & Simpson

[57] ABSTRACT

A printing sheet which is adapted for use in thermal transfer recording comprises a substrate (1) and a dye image-receiving layer (2) formed on the substrate. The layer (2) comprises an isocyanate group-containing polymer having at least one polysiloxane moiety and at least one urethane bond site therein. The isocyanate group-containing polymer is a reaction product between polyfunctional polyisocyanate compound and alcohol-modified silicone. A method for making such a sheet is also described.

11 Claims, 1 Drawing Sheet

PRINTING SHEET COMPRISING A DYE RECEIVING LAYER MADE OF AN ISOCYANATE GROUP-CONTAINING POLYMER

BACKGROUND OF THE INVENTION

This invention relates to a printing sheet which is adapted for use in thermal transfer printing systems, particularly, a thermal transfer printing system using sublimable dyes. More particularly, it relates to a printing sheet which has both good sebum resistance and good writeability and also to a method for making the printing sheet.

As is known in the art, there have been widely used thermal transfer printing methods wherein an ink ribbon is heated according to image information by use of a thermal head or a laser beam to transfer, to a print sheet, an ink from the ink ribbon by thermal melting or diffusion or sublimation. In recent years, attention has been paid to so-called sublimation-type thermal transfer printing methods wherein full color images with a continuous tone or gradation are formed using thermally diffusable dyes such as sublimable dyes. For instance, attempts have been made to form images on a video printing sheet by selectively heating an ink ribbon according to signals of video images.

As a video image printing sheet, there is used a sheet substrate such as of polypropylene and a dye image-receiving layer formed on the substrate. The dye image-receiving layer is able to receive the dye transferred from an ink ribbon by heating and retains the resultant image thereon. The image-receiving layer has been conventionally made of resins which are susceptible to dyeing with dyes. Such resins include thermoplastic resins such as polyesters, polycarbonates, polyvinyl chloride, vinyl chloride copolymers such as vinyl chloride-vinyl acetate copolymers, polyurethanes, polystyrene, AS resins, ABS resins and the like.

Recently, in order to enhance sensitivity enough to form clear images and to improve the weatherability, light fastness and thermal stability of images so that once formed images can be stably kept, various attempts have been made on resins for the dye image-receiving layer. For instance, in order to improve the light fastness and weatherability of images, there has been proposed a dye image-receiving layer which is made mainly of cellulose esters (U.S. Pat. No. 5,278,130).

However, as the thermal transfer printing methods have been widespread, there is an increasing demand for satisfying the following characteristic properties, not to mention the improvements in the weatherability, light fastness and thermal stability. More particularly, there is a demand for realizing a printing sheet which has a good sebum resistance so that when a dye-receiving layer on which images have been formed is rubbed with a finger, the image is not attached to the finger. Moreover, there is also a demand for realizing a printing sheet which has such good writeability or writing properties that when the printing sheet is directly written on the dye-receiving layer thereof with oil base ink pens, the ink is stably fixed in the sheet.

However, known printing sheets cannot satisfy the requirements for both sebum resistance and writing properties. In order to improve the sebum resistance so as not to permit the finger having rubbed the image surface therewith to be attached with the dye, it is desirable to use a resin for the dye-receiving layer which is highly oil-repellent in nature to prevent the sebum from infiltration into the inside of the receiving layer. On the other hand, for the improvement in writing properties of a printing sheet which allows direct writing on the printing sheet by use of an oil base ink pen or marker, a resin for the receiving layer should favorably be oleophilic, not oil-repellent, unlike the case where the sebum resistance is improved. By this, a dye or an ink dispersing a dye therein can be infiltrated in the dye-receiving layer. Thus, the properties which are required for the resin in the dye-receiving and include a property for improving the sebum resistance and a property for improving the writing properties are contrary to each other. The improvements of both properties have been empirically difficult. For instance, where isocyanate crosslinking agents are incorporated in the dye-receiving layer for crosslinking reaction in order to improve the sebum resistance, an oily ink is unlikely to infiltrate into the dye-receiving layer, resulting in the lowering of the writing properties.

SUMMARY OF THE INVENTION

It is accordingly an object of the invention to provide a printing sheet which can solve the problems involved in the prior art.

It is another object of the invention to provide a printing sheet wherein while fundamental characteristics such as thermal transfer sensitivity and image stability are satisfied, both sebum resistance and writing properties of a dye-receiving layer are improved.

It is a further object of the invention to provide a method for making a printing sheet of the type mentioned above.

We have found that the above objects can be achieved when using an isocyanate group-containing polymer, which has at least one polysiloxane moiety and at least one urethane bond site therein, as a dye-receiving layer of a printing sheet.

More particularly, according to one embodiment of the invention, there is provided a printing sheet which is adapted for use in thermal transfer printing systems, the sheet comprising a substrate and a dye-receiving layer formed on the substrate, the dye-receiving layer comprising an isocyanate group-containing polymer having at least one polysiloxane moiety and at least one urethane bond site therein.

According to another embodiment of the invention, there is also provided a method for making a printing sheet which comprises:

subjecting a polyfunctional polyisocyanate compound and an alcohol-modified silicone to reaction with each other to obtain an isocyanate group-containing polymer having at least one polysiloxane moiety and at least one urethane bond site;

preparing a resin composition comprising the isocyanate group-containing polymer; and applying the resin composition onto a substrate to form a dye-receiving layer on the substrate.

DETAILED DESCRIPTION AND EMBODIMENTS OF THE INVENTION

Figure 1:
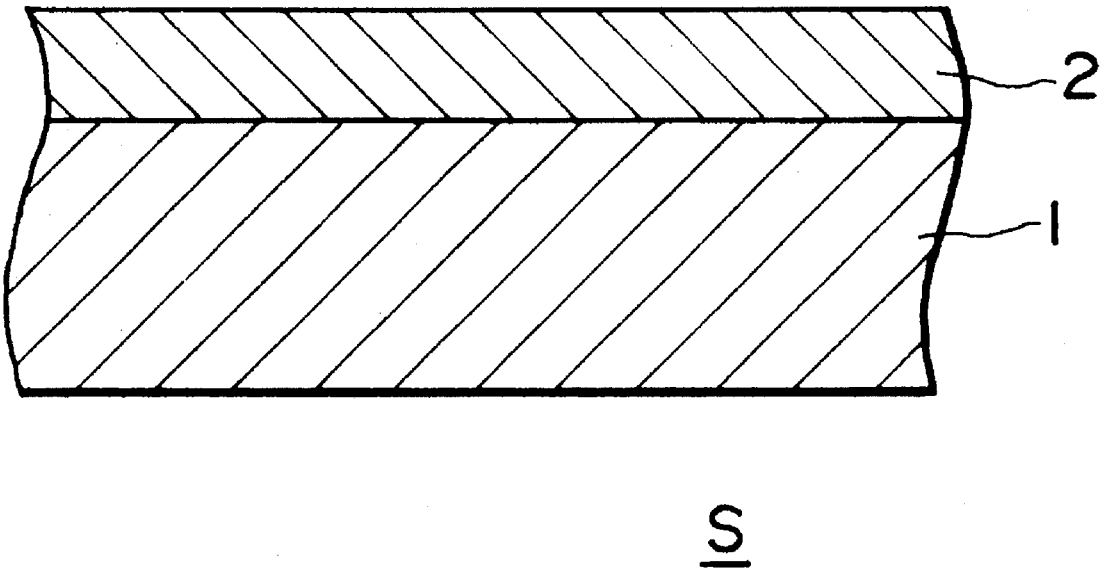
FIG. 1 is a schematic sectional view of a printing sheet according to the invention.

Reference is now made to the accompanying drawing which illustrates a printing sheet according to a preferred embodiment of the invention. As shown in FIG. 1, a printing sheet S of the invention has a builtup structure including a substrate 1 and a dye-receiving layer 2 formed on the substrate 1. The dye-receiving layer 2 contains an isocyanate group-containing polymer.

The isocyanate group-containing polymer should have at least one active isocyanate group, at least one moiety and at least one urethane bond site. Using the isocyanate group-containing polymer, fundamental characteristics such as thermal transfer sensitivity and storage stability are satisfied and both sebum resistance and writeability can be improved.

The molecular weight of the isocyanate group-containing polymer may vary depending on the purpose and use conditions of the sheet and is preferably in the range of from 3,000 to 15,000.

Such a polymer should preferably be reaction products of polyfunctional polyisocyanate compounds and alcohol-modified silicones at both ends thereof.

These reaction products are prepared by mixing both ingredients under heating conditions preferably in solvents. The active isocyanate group or groups in the polymer are derived from the polyfunctional polyisocyanate compound and the polysiloxane moiety or moieties are derived from the silicone used. Moreover, the urethane site or sites are derived from the isocyanate groups of the polyfunctional polyisocyanate compound and the terminal hydroxyl group or groups of the alcohol-modified silicone.

The polyfunctional polyisocyanate compounds should have not less than two isocyanate groups and preferably three or four isocyanate groups. Specific examples are ones which are used as starting materials for polyurethanes and include adducts, biuret products and isocyanurate products of aromatic isocynates such as 2,4-tolylene diisocyanate (2,4-TDI), 2,6-TDI, diphenylmethane-4,4'-diisocyanate (MDI), hydrogenated MDI, 1,5-naphthalene diisocyanate, triphenylmethane triisocyanate, xylylene diisocyanate (XDI), hydrogenated XDI, meta-xylylene diisocyanate (TODI) and the like, aliphatic isocyanates such as isophorone diisocyanate (IPDI), trimethylhexamethylene diisocyanate (TDMI), hexamethylene diisocyanate (HDI), dimethyl diisocyanate (DDI) and the like.

The polyfunctional polyisocyanate compounds have preferably a molecular weight of 500 to 1000.

The alcohol-modified silicones may have those silicones which have a hydroxyl group at one or both ends thereof, of which the hydroxyl group is preferred to be at both ends. These silicones are, for example, commercially available under the designations of X-22161AS, KF-6001, KF-6002 and KF-6003 from Shin-Etsu Chemical Ind. Co., Ltd., all of which have an OH group at both ends, and under the designation of XF3968 from Toshiba Silicone Co., Ltd., which has an OH group at one end.

The silicones have preferably a molecular weight of 1000 to 6000, more preferably from 2000 to 3000.

As having set out hereinabove, the dye-receiving layer 2 has an isocyanate group-containing polymer. It is preferred to add, aside from the isocyanate group-containing polymer, thermoplastic or curing resins. These resins may be ones which are ordinarily used in dye-receiving layers. For instance, examples of the thermoplastic resin include polyesters, polycarbonates, polyvinyl chloride, vinyl chloride copolymers such as vinyl chloride-vinyl acetate copolymers, polyvinyl acetal, polyvinylbutyral, polyamides, polyvinyl acetate, polyurethanes, polystyrene, AS resins, ABS resins, cellulose resins, cellulose ester resins, polyvinyl alcohol, acrylic resins, synthetic rubbers such as SBR, NBR, etc., and the like. Examples of the curing resins include thermosetting resins, UV-curing resins and electron beam curing resins such as phenolic resins, unsaturated polyester resins, melamine resins, urea resins and the like. These may be used singly or in combination. In view of sensitivity, image stability, writing properties and sebum resistance, polyesters and/or cellulose esters are preferred.

In combination with resins used as a film-forming ingredient, if the content of the isocyanate group-containing polymer in the dye-receiving layer 2 is too small, the sebum resistance cannot be improved satisfactorily. On the contrary, when the content is too large, the transfer sensitivity lowers. Accordingly, it is preferred that the isocyanate group-containing polymer is present in an amount of from 0.5 to 30 parts by weight per 100 parts by weight of the resin although the polymer may be used as it is as the receiving layer, if required.

If necessary, various additives which are miscible with the isocyanate group-containing polymers and resin ingredients may be added to the dye-receiving layer 2. For instance, there may be mentioned various esters, ethers and other hydrocarbon compounds as additives (sensitizers) which are capable of forming an amorphous phase after miscibility with thermoplastic resins to facilitate dye diffusion (dye reception) thereby permitting the dye to be infiltrated into the receiving layer to improve light fastness and heat resistance.

The esters, ethers and hydrocarbon compounds may be in the form of liquids or solids having a melting point of approximately −50° to 150° C. For instance, the esters include phthalic esters such as dimethyl phthalate, diethyl phthalate, dioctyl phthalate, dicyclohexyl phthalate, diphenyl phthalate and the like, isophthalic esters such as dicyclohexyl isophthalate, aliphatic dibasic esters such as dioctyl adipate, dioctyl sebacate, dicyclohexyl azalate and the like, phosphoric esters such as triphenyl phosphate, tricyclohexyl phosphate, triethyl phosphate and the like, higher fatty acid esters such as dimethyl isophthalate, diethyl isophthalate, butyl stearate, cyclohexyl laurate and the like, silicic esters and boric esters. The ethers include, for example, diphenyl ether, dicyclohexyl ether, methyl p-ethoxybenzoate and the like. The hydrocarbon compounds include, for example, camphor, low molecular weight polyethylene, phenols such as p-phenylphenol, o-phenylphenol and the like, N-ethyltoluenesulfonic acid amide, and the like.

Fluorescent brighteners and white pigments may be further added to the dye image-receiving layer of the printing sheet according to the invention. By this, the whiteness of the layer is improved to enhance the clarity of images and the layer is imparted with good writing properties on the surface thereof. In addition, once formed images are prevented from re-transferring. Such fluorescent brighteners and white pigments may be commercially available ones. For instance, Ubitex OB commercially available from Ciba-Geigy GF can be used as a fluorescent brightener.

Moreover, antistatic agents may be further added to the layer in order to prevent static electricity from being generated during running through a printer. Examples of the agent include cationic surface active agents such as quaternary ammonium salts, polyamide derivatives and the like, anionic surface active agents such as alkylbenzene sulfonates, sodium alkylsulfates and the like, amphoteric surface active agents, and non-ionic surface active agents. These antistatic agents may be incorporated in the image-receiving layer or may be coated on the surface of the layer.

Besides, plasticizers, UV absorbers and antioxidants may be appropriately formulated in the dye-receiving layer.

It is important that for the fabrication of the printing sheet of the invention, an isocyanate group-containing polymer be first prepared, and the polymer and, optionally, a film-forming resin be mixed to prepare a composition from which a dye-receiving layer is formed. Where the composition used to form the receiving layer is prepared by mixing starting polyfunctional polyisocyanate compound and alcohol-modified silicone resin with a film-forming resin without the preliminary formation of the isocyanate group-containing polymer, the dye-receiving layer formed from the composition cannot exhibit a satisfactory effect of the invention.

In the practice of the invention, the printing sheet is made by first preparing an isocyanate group-containing polymer having a polysiloxane moiety or moieties and a urethane bond site or sites by reaction between the polyfunctional polyisocyanate compound and an alcohol-modified silicone, then preparing a composition comprising the resultant isocyanate group-containing polymer and coating the composition on a substrate by a usual manner to form a dye-receiving layer.

The printing sheet of the invention is characterized by comprising such a dye-receiving layer as set out hereinabove. The sheet of the invention other than the receiving layer may be arranged in the same manner as in prior art. For instance, the substrate 1 may be paper sheets such as wood-free paper, coated paper and the like, various types of plastic sheets, and laminated sheets thereof, like known printing sheets. If necessary, the substrate may have a lubricating layer on a side opposite to the side on which the receiving layer is formed. Images may be formed on the printing sheet of the invention according to any known procedures. Dyes to be transferred are not critical with respect to the kind.

Since the printing sheet of the invention has a dye image-receiving layer which contains an isocyanate group-containing polymer having at least one polysiloxane moiety and at least one urethane bond site, the sebum resistance and writing properties are both improved while satisfying fundamental characteristics such as thermal transfer sensitivity and storage stability.

The invention is more particularly described by way of examples wherein parts are by weight unless otherwise indicated.

Reference (preparation of isocyanate group-containing polymers)

An alcohol-modified silicone and polyfunctional polyisocyanate compounds, indicated in Table 1, were dissolved in a mixed solvent of toluene and methyl ethyl ketone at a mixing ratio of 5:1 to make 20% solutions, followed by reaction at 80° C. for 24 hours to prepare isocyanate group-containing polymer solutions A, B and C.

It will be noted that the alcohol-modified silicone and the respective polyfunctional polyisocyanate compound were used in such an amount that the ratio by equivalent between the isocyanate group and the OH group (NCO/OH) was 5:1.

TABLE 1

| Isocyanate group-containing polymer solution | Alcohol-modified silicone | Polyfunctional polyisocyanate compound |
|---|---|---|
| A | SF-8427 | Coronate L |
| B | SF-8427 | Sumidur N-75 |
| C | SP-8427 | Coronate L + Sumidur N-75 |

In Table 1, the abbreviation "SF-8427" is a commercial name of an alcohol-modified silicone of Toray-Dow Silicone Co., Ltd., "Coronate L" is a commercial name of a TDI-based polyfunctional polyisocyanate compound of Nippon Polyurethane Co., Ltd., and "Sumidur N-75" is a commercial name of an HDI-based polyfunctional polyisocyanate compound of Sumitomo-Bayer Urethane Co., Ltd.

Examples 1 to 12 and Comparative Examples 1 to 3

200 parts of methyl ethyl ketone and 200 parts of toluene were added to the respective mixtures of the ingredients indicated in Table 2 to prepare compositions used to form dye-receiving layers.

For comparison, the respective ingredients indicated in Table 2 were merely mixed, without formation of any isocyanate group-containing polymers by preliminary reaction between the alcohol-modified silicones and the polyfunctional polyisocyanates, thereby preparing compositions used top form dye-receiving layers.

TABLE 2

| | Ingredient | Amount |
|---|---|---|
| Example 1 | CAB 551-0.01 | 100 |
| | isocyanate group-containing polymer solution A | 5 |
| Example 2 | CAB 551-0.01 | 100 |
| | isocyanate group-containing polymer solution A | 10 |
| Example 3 | CAB 551-0.01 | 100 |
| | isocyanate group-containing polymer solution A | 15 |
| Example 4 | CAB 551-0.01 | 100 |
| | isocyanate group-containing polymer solution B | 5 |
| Example 5 | CAB 551-0.01 | 100 |
| | isocyanate group-containing polymer solution B | 10 |
| Example 6 | CAB 551-0.01 | 100 |
| | isocyanate group-containing polymer solution C | 5 |
| Example 7 | CAB 551-0.01 | 100 |
| | isocyanate group-containing polymer solution C | 15 |
| Example 8 | #1000GK | 100 |
| | isocyanate group-containing polymer solution A | 15 |
| Example 9 | BM-2 | 100 |
| | isocyanate group-containing polymer solution B | 10 |
| Example 10 | Stylac 709 | 100 |
| | isocyanate group-containing polymer solution B | 10 |
| Example 11 | CAB 551-0.01 | 100 |
| | isocyanate group-containing polymer solution C | 5 |
| | Coronate L | 5 |
| Example 12 | CAB 551-0.01 | 100 |
| | isocyanate group-containing polymer solution C | 5 |
| | Sumidur N-75 | 5 |
| Comp. Ex. 1 | CAB 551-0.01 | 100 |
| | Sumidur N-75 | 5 |
| | SF-8427 | 5 |
| Comp. Ex. 2 | CAB 551-0.01 | 100 |
| | Coronate L | 5 |
| | SF-8427 | 5 |
| Comp. Ex. 3 | Stylac 709 | 100 |
| | SF-8427 | 5 |
| | Sumidur N-75 | 5 |

In Table 2, "CAB 551-0.01" is a commercial name of cellulose acetylbutyrate of Eastman Kodak, "#1000GK" is a commercial name of vinyl chloride-vinyl acetate copolymer of Denki Chem. Ind. Co., Ltd., "BM-2" is a commercial name of polyvinyl butyral of Sekisui Chem. Ind. Co., ltd., "Stylac 709" is a commercial name of AS resin of Asahi Chem. Co., Ltd., and "Sumidur N-75", "SF-8427" and "Coronate L" are those set out hereinbefore with respect to Table 1.

The thus obtained composition solutions used to form a dye-receiving layer were each applied onto a 150 μm thick synthetic paper (FPG-150 available from Ohji Paper Mfg. Co., Ltd.) in a dry thickness of 10 μm according to a die coating process and cured at 120° C. for 2 minutes to obtain a printing sheet.

Evaluation

The respective printing sheets were subjected to solid printing by use of a sublimation transfer ink ribbon (VPM-30 of Sony Corporation and a sublimation color video printer (CVP-G7 of Sony Corporation). The resultant images were evaluated in the following manner with respect to optical density, writing properties, sebum resistance and light fastness stability. The results are summarized in Table 3.

(i) Optical density

Measured by use of the Macbeth densitometer RD914.

(ii) Writing properties

An oil base ink pen (Tombow F-1 of Tombow Pencil Co., Ltd.) was used to write on individual test sheets, followed by visual observation of the written surface. The written state was evaluated as "o" for good, "Δ" for slightly poor and "x" for poor.

(iii) Sebum resistance

A corn oil was applied onto the printed surface and allowed to stand over 30 minutes. The oil-attached portion and non-attached portion of the printed surface were, respectively, visually observed. The case when no ink was migrated from the dye-receiving layer toward the corn oil was evaluated as "o", a slight degree of the migration was as "Δ" and a substantial degree of the migration was as "x".

(iv) Light fastness stability

The black solid print sheet was subjected to a light fastness test wherein an Atlas weatherometer was used under conditions of 63° C., 50% R. H. and 48 hours, followed by visual observation of a degree in lowering of image density. Little or no lowering of the density being observed was evaluated as "o", a light degree of lowering of the density was as "Δ" and a substantial degree of the lowering was as "x".

TABLE 3

| | Optical Density | Sebum Resistance | Writing Property | Light Fastness |
|---|---|---|---|---|
| Example | | | | |
| 1 | 2.40 | o | o | o |
| 2 | 2.35 | o | o | o |
| 3 | 2.33 | o | o | o |
| 4 | 2.41 | o | o | o |
| 5 | 2.37 | o | o | o |
| 6 | 2.42 | o | o | o |
| 7 | 2.39 | o | o | o |
| 8 | 2.42 | o | o | o |
| 9 | 2.31 | o | o | o |
| 10 | 2.25 | o | o | o |
| 11 | 2.37 | o | o | o |
| 12 | 2.39 | o | o | o |
| Comp. Ex. | | | | |
| 1 | 2.39 | x | o | o |
| 2 | 2.30 | x | x | o |
| 3 | 2.23 | Δ | o | o |

As will be apparent from the results of Table 3, the printing sheets of the examples have good optical density, sebum resistance, light fastness stability and writing property. However, the printing sheets of the comparative examples are disadvantageous in that the dye is migrated from the dye-receiving layer toward the corn oil, so that the sebum resistance is not satisfactory. The sheet of Comparative Example 2 is poor in the writing property.

What is claimed is:

1. A printing sheet for use in a thermal transfer printing system, including a substrate having a dye-receiving layer thereon, said dye-receiving layer consisting essentially of 100 parts by weight of at least one film-forming resin selected from the group consisting of AS resins, cellulose acetylbutyrate resins, polyvinyl butyral resins, and vinyl chloride-vinyl acetate copolymer resins and from about 0.5 to about 30 parts by weight of said film-forming resin of an isocyanate group-containing polymer produced by reacting a mixture consisting essentially of a multi-functional polyisocyanate and a hydroxy-terminated silicone, said dye-receiving layer optionally including at least one additive selected from the group consisting of sensitizers, fluorescent brighteners, white pigments, antistatic agents, plasticizers, ultraviolet absorbers and antioxidants.

2. A printing sheet as defined in claim 1, wherein the multifunctional polyisocyanate component (a) is selected from the group consisting of 2,4-tolylene diisocyanate, 2,6-tolylene diisocyanate, diphenylmethane-4,4'-diisocyanate, hydrogenated diphenylmethane-4,4'-diisocyanate, 1,5-napthalene diisocyanate, triphenylmethane triisocyanate, xylylene diisocyanate, hydrogenated xylylene diisocyanate, metaxylylene diisocyanate, 3,3'-dimethyl-4,4'-diphenylene-diisocyanate and adducts, biurets and isocyanurates of any of the foregoing aromatic isocyanates, isophorone diisocyanate, trimethylhexamethylene diisocyanate, hexamethylene diisocyanate and dimethyl diisocyanate.

3. A printing sheet as defined in claim 1, wherein the multifunctional polyisocyanate component has a molecular weight of about 500 to about 1,000.

4. A printing sheet as defined in claim 1, wherein the hydroxy-terminated silicone has a molecular weight of about 1,000 to about 6,000.

5. A printing sheet as defined in claim 1, wherein the hydroxy-terminated silicone has a molecular weight of about 2,000 to about 3,000.

6. A printing sheet as defined in claim 1, wherein the multifunctional polyisocyanate is selected from aromatic and aliphatic polyisocyanates containing two or more isocyanate groups per molecule.

7. A printing sheet as defined in claim 1, wherein the hydroxy-terminated silicone and the multifunctional polyisocyanate are present in said polymer in an equivalent ratio of isocyanate groups to hydroxyl groups of about 5:1.

8. A method for making a printing sheet comprising the steps of:

reacting a mixture consisting essentially of a multifunctional polyisocyanate with a hydro-terminated silicone to obtain an isocyanate group-containing polymer;

preparing a resin composition comprising the isocyanate group-containing polymer; and applying the resin composition onto a substrate to form a dye-receiving layer on the substrate.

9. A method according to claim 8, wherein the multifunctional polyisocyanate has three isocyanate groups therein.

10. A method according to claim 8, wherein the multifunctional polyisocyanate has four isocyanate groups therein.

11. A method according to claim 8, wherein the isocyanate group-containing polymer has a molecular weight of about 3,000 to about 15,000.

* * * * *